US006533576B1

(12) United States Patent
Sher

(10) Patent No.: US 6,533,576 B1
(45) Date of Patent: Mar. 18, 2003

(54) LIGHTER WITH CHILD RESISTANT ACTUATING LEVER

(75) Inventor: Tak Chi Sher, Quarry Bay (HK)

(73) Assignee: Polycity Enterprise Limited, Quarry Bay (HK)

( * ) Notice: Subject to any disclaimer, the term of this patent is extended or adjusted under 35 U.S.C. 154(b) by 0 days.

(21) Appl. No.: 09/261,451

(22) Filed: Mar. 3, 1999

(51) Int. Cl.[7] ..... F23Q 3/01; F23Q 2/28; H01L 41/08

(52) U.S. Cl. ..... 431/255; 431/153; 310/339

(58) Field of Search ..... 431/275, 255, 431/132, 153; 310/339; 317/81, DIG. 11; 361/260

(56) References Cited

U.S. PATENT DOCUMENTS

| | | | | | |
|---|---|---|---|---|---|
| 1,746,949 | A | | 2/1930 | Kollstede | |
| 1,762,079 | A | | 6/1930 | Rubsamen | |
| 2,262,806 | A | | 11/1941 | Kempf et al. | |
| 2,449,414 | A | | 9/1948 | Rogers | |
| 2,695,508 | A | | 11/1954 | Gruber | |
| 2,724,253 | A | | 11/1955 | Morgan | |
| 2,795,945 | A | | 6/1957 | Coenders | |
| 3,079,781 | A | | 3/1963 | Virtanen | |
| 3,088,301 | A | | 5/1963 | Gruber et al. | |
| 3,116,622 | A | * | 1/1964 | Goddard et al. | 431/275 |
| 3,328,980 | A | | 7/1967 | Reim | |
| 3,540,823 | A | * | 11/1970 | Ebine et al. | 431/255 |
| 3,734,680 | A | * | 5/1973 | Maruyama | 431/255 |
| 3,826,952 | A | * | 7/1974 | Iwasaki et al. | 431/255 |
| 3,841,365 | A | | 10/1974 | Vaughan | |
| 3,895,904 | A | | 7/1975 | Kimball | |
| 3,938,943 | A | | 2/1976 | Malamoud | |
| 3,947,731 | A | | 3/1976 | Vainer | |
| 3,966,392 | A | | 6/1976 | Lockwood | |
| 4,258,739 | A | | 3/1981 | Blankenship et al. | |
| 4,687,437 | A | | 8/1987 | Springer | |
| 4,717,335 | A | | 1/1988 | Loveless | |
| 4,822,276 | A | | 4/1989 | Bisbee | |
| 5,066,220 | A | | 11/1991 | Vick | |
| 5,074,781 | A | | 12/1991 | Fujita | |
| 5,085,578 | A | | 2/1992 | Hunter | |
| 5,090,893 | A | | 2/1992 | Floriot | |
| 5,092,764 | A | | 3/1992 | McDonough et al. | |
| 5,104,313 | A | | 4/1992 | Zellweger | |
| 5,125,829 | A | | 6/1992 | McDonough et al. | |
| 5,165,885 | A | | 11/1992 | Iwahori | |
| 5,184,948 | A | | 2/1993 | Iwahori | |
| 5,186,618 | A | | 2/1993 | Shike et al. | |
| 5,197,870 | A | | 3/1993 | Yang | |
| 5,213,493 | A | | 5/1993 | Iwahori | |
| 5,213,495 | A | | 5/1993 | Pan | |
| 5,215,458 | A | | 6/1993 | Cirami | |
| 5,224,854 | A | | 7/1993 | Ansquer | |
| 5,228,849 | A | * | 7/1993 | Frigiere | 431/255 |
| 5,236,351 | A | | 8/1993 | Tien | |
| 5,271,731 | A | | 12/1993 | Hsin-Chung | |
| 5,356,286 | A | | 10/1994 | Sher | |
| 5,407,346 | A | | 4/1995 | Sher | |
| 5,413,230 | A | | 5/1995 | Folter et al. | |
| 5,421,720 | A | | 6/1995 | Sher | |
| 5,460,516 | A | | 10/1995 | Sher | |
| 5,490,773 | A | | 2/1996 | Lloveras Capilla | |
| 5,509,799 | A | | 4/1996 | Sher | |
| 5,584,683 | A | | 12/1996 | Sher | |
| 5,769,625 | A | | 6/1998 | Sher | |
| 5,788,476 | A | | 8/1998 | Sher | |
| 5,846,069 | A | | 12/1998 | Sher | |
| 5,854,530 | A | * | 12/1998 | La Forest | 431/255 |
| 5,971,751 | A | * | 10/1999 | Lee | 431/153 |

FOREIGN PATENT DOCUMENTS

| | | |
|---|---|---|
| DE | 819 929 | 7/1949 |
| DE | 1 176 909 | 8/1964 |
| EP | 0 296 281 | 6/1978 |
| FR | 495249 | 1/1919 |
| FR | 1358948 | 6/1963 |
| GB | 1255510 | 12/1971 |

* cited by examiner

*Primary Examiner*—Carl D. Price
(74) *Attorney, Agent, or Firm*—Ladas & Parry

(57) ABSTRACT

A lighter. The lighter includes a container for storing a combustible fuel and a source of ignition. The source of ignition is responsive to the manual manipulation of an actuating member and a member resisting the operation of the actuation member so that the source of ignition is not activated in response to forces less than approximatey 3.5 kgf.

7 Claims, 7 Drawing Sheets

LIGHTER WITH CHILD RESISTANT ACTUATING LEVER

FIELD OF THE INVENTION

This invention related to the field of lighters, such as cigarette lighters.

BACKGROUND OF THE INVENTION

Conventional butane lighters comprise a lighter body within which is housed a reservoir containing butane or other suitable fuel, a mounting frame affixed atop the lighter body, a nozzle inserted through the mounting frame into connected relationship with the reservoir, a lever for actuating the nozzle, and a piezoelectric igniter or a more conventional mechanical igniter such as a striker wheel, flint and flint-spring combination. The igniter is positioned close to the rear end of the lever so that the igniter and the rear end of the lever may be actuated simultaneously or nearly so.

Lighters which pre-date butane lighters are similar to the above-identified conventional butane lighters except that instead of having a nozzle in connected relationship with the reservoir, a wick or similar device is used, and there is no need for a nozzle actuating lever. Such lighters typically have traditional mechanical igniters with striker wheels and flints.

While the traditional mechanical igniter with striker wheel and flint can still be found in the marketplace, the butane lighter equipped with a piezoelectric igniter has become very popular. Instead of using a striker wheel and flint, a modern lighter is equipped with a piezoelectric unit which draws a spark when operated. The piezoelectric unit is typically operated by a thumb-operated push cap which not only operates the lever for actuating the nozzle, but also operates the piezoelectric unit to draw a spark, causing a flame to shoot upward from the lighter.

Piezoelectric igniters are popular because the spark which they draw is very predictable compared with the older mechanical igniters known in the art.

The safety device of the present invention works effectively with either form of lighter and with either form of igniter.

One of the reasons for the popularity of modern lighters is the fact that the height of the flame produced by the lighter can be varied over a wide range by varying the amount of fuel allowed to be ejected from the lighter. The very feature that makes such lighters dangerous if they are ignited. When the lighter produces a flame in an uncontrolled circumstance, particularly when the lighter is set on its high setting, materials (such as curtains, clothing, hair) may accidentally be lit on fire. Modern butane lighters are particularly dangerous when they are in the hands of children. This is true whether the igniter is a traditional striker wheel and flint arrangement or is embodied by a more modern piezoelectric device.

SUMMARY OF THE INVENTION

In a preferred embodiment of the invention, the lighter comprises an igniter, a fuel source and a push button, typically thumb-operated, for releasing the fuel from the fuel source via a nozzle in the vicinity of the igniter. When the igniter is embodied by a traditional striker wheel and flint arrangement, the igniter wheel is positioned adjacent the push button so that the user can cause the striker wheel to rotate and can depress the push button in more or less one continuous motion. If, on the other hand, a piezoelectric igniter is used, then the piezoelectric igniter is typically operated as the push button is depressed to release the fuel from the fuel source. The lighter also includes a spring which is placed in a position to act against the depression of the push button in order to increase the child resistance of the lighter. With the spring action, additional force is required to activate push button making it more difficult for children to depress the push button in order to activate the lighter.

THE PRIOR ART

Figure 1:
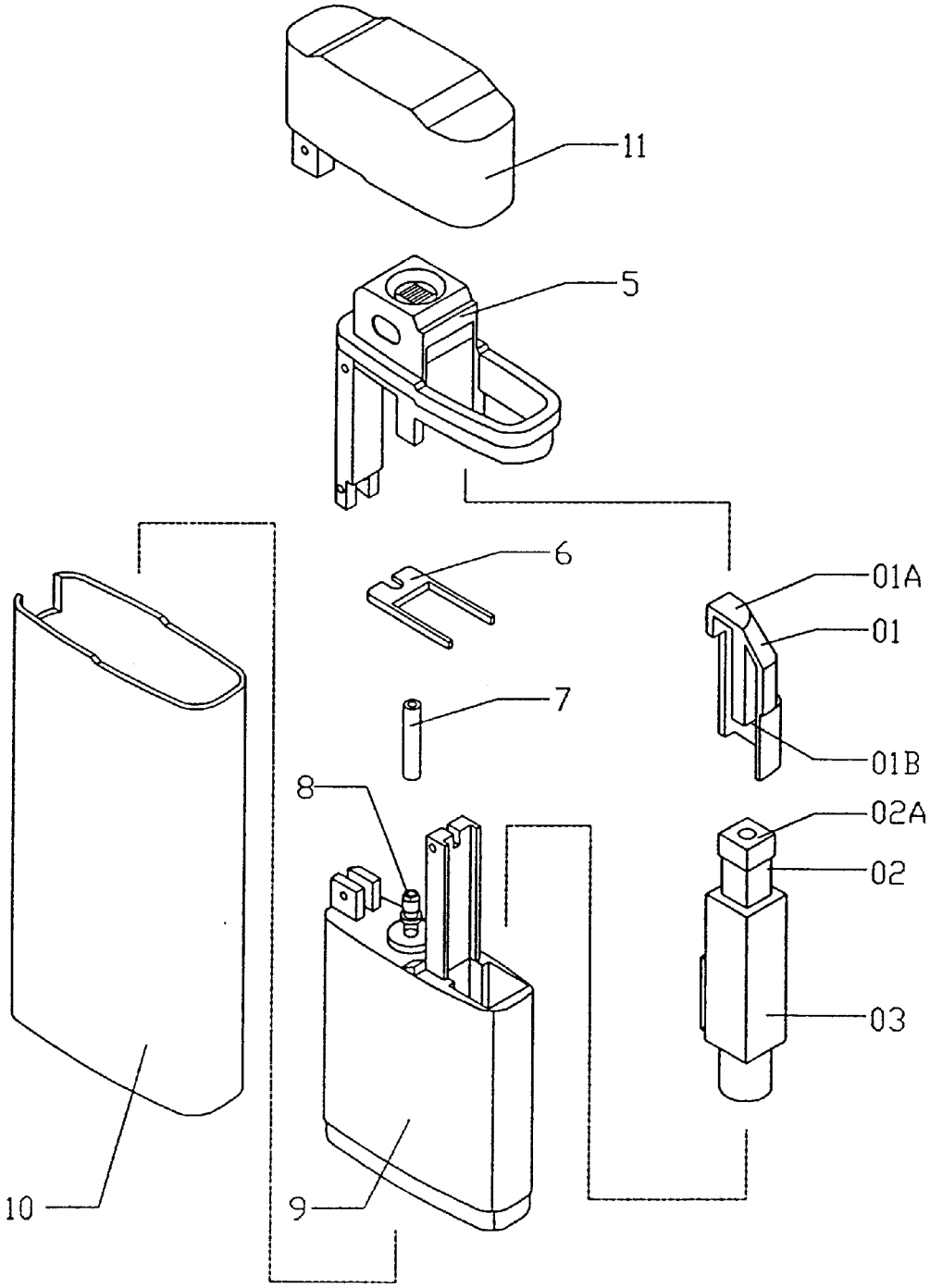
FIG 1 (PRIOR ART)
FIG. 1 is an exploded view of a piezoelectric lighter of the type known in the prior art.

FIG. 1 shows a conventional butane lighter of the type known in the prior art. The butane lighter includes a push button 1 and a piezoelectric unit 2, 3. Butane fuel is stored in a fuel reservoir 9 in the lighter and can be released to ambient via a valve adjacent or near nozzle 8. Piece 5 is used to help keep the various components in proper alignment, to conveniently encase them in lighter body 10 and to help attach cap 11.

Figure 1A:
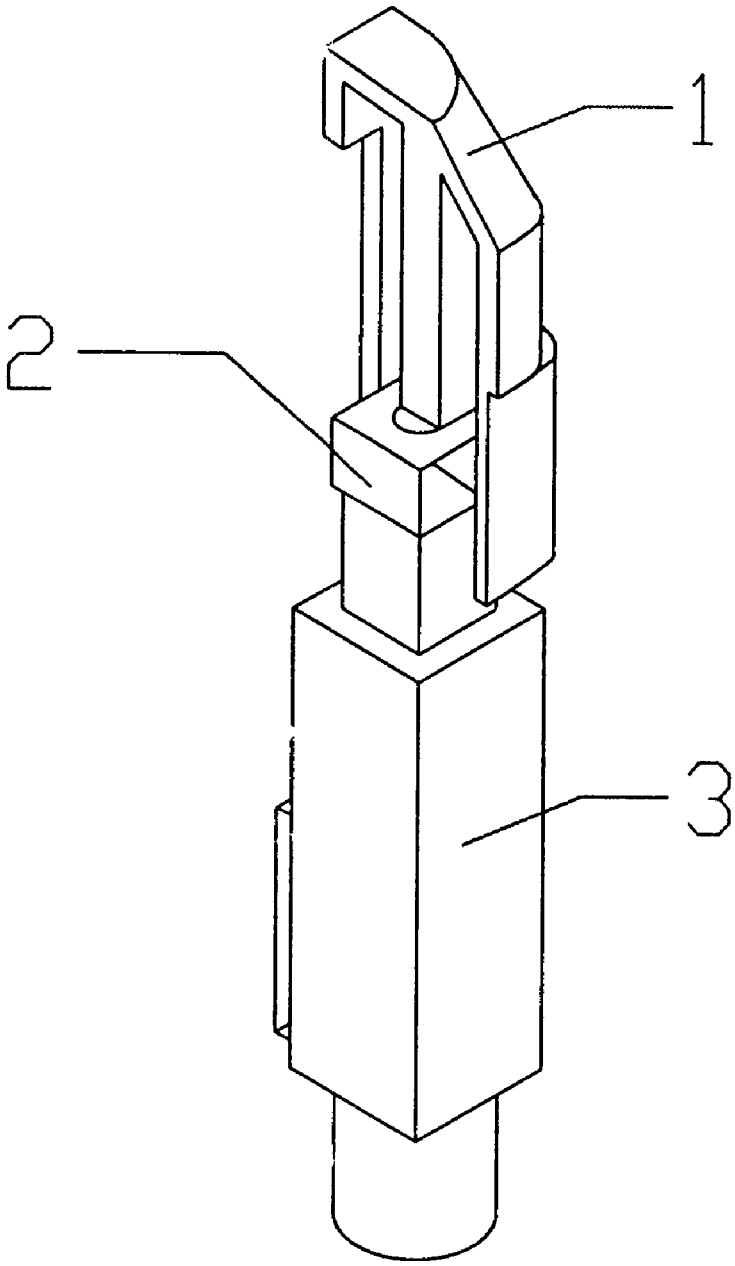
FIG 1A (PRIOR ART)
FIGS. 1A and 1B depict the piezoelectric igniter unit shown in FIG. 1 in greater detail.
Figure 1B:
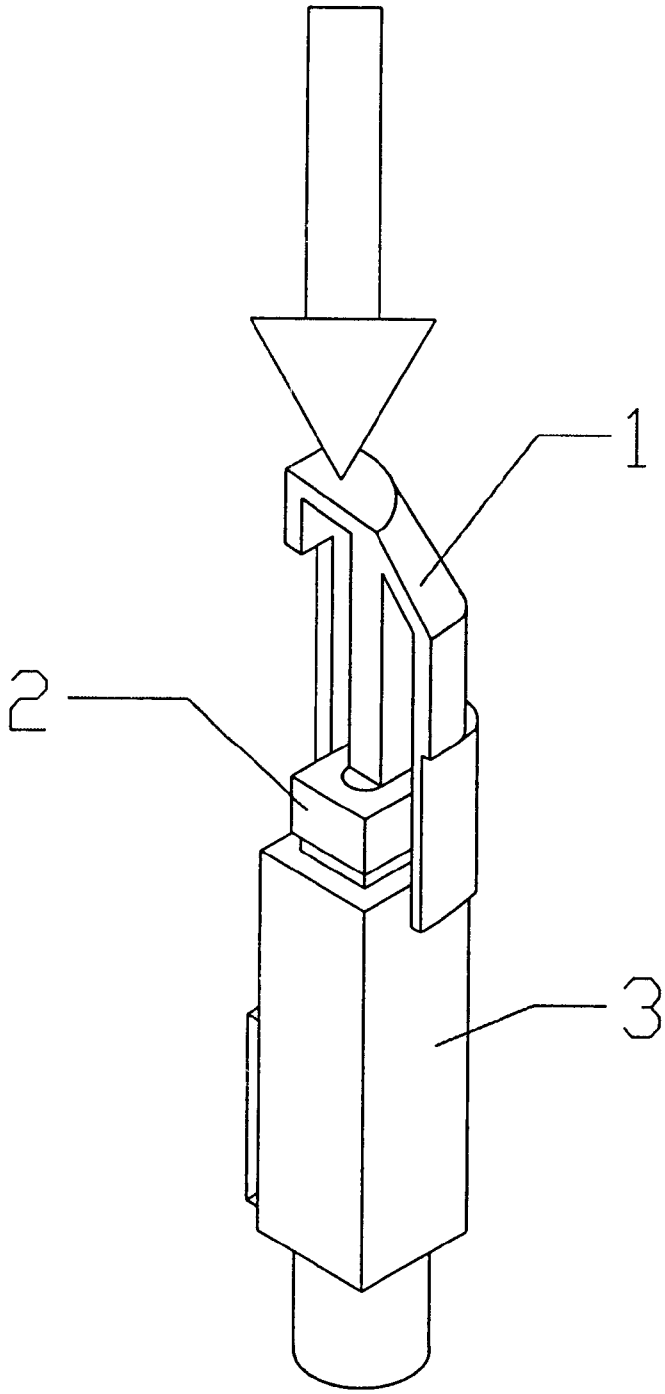
FIG 1B (PRIOR ART)

Elements 2 and 3 of the piezoelectric unit are moveable with respect to each other and when they do move, they induce an electrical charge through piezoelectric action to produce a flame when the lighter is lit and the fuel is released. A piezoelectric unit 2, 3 is shown in greater detail in FIGS. 1A and 1B. In FIG. 1A it is shown in its normal, unactuated state. In FIG. 1B it is shown in its actuated (depressed) spark inducing state. In normal operation, when the actuating lever or push button 1 is depressed, the piezoelectric device 2, 3 is actuated causing an electric current to be conducted through a conductor or conducting wire (not shown) to somewhere near the outlet of nozzle 8 as an ignition source. The depression of the push button or actuating lever 2 simultaneously causes the rear part of gas lever 6 to move in a downward direction. As a result, the front part of the gas lever 6, which engages nozzle 8, moves upwardly causing nozzle 8 to raise and its associated valve to open. Of course, the opening of the valve allows the fuel to flow or release from the fuel reservoir 9 to fuel the aforementioned flame. Such operations are quite simple and the lighter can be easily mishandled by a child.

In prior art lighters of the type shown in FIG. 1 a force of 1.5 to 2.0 kgf is required to depress actuating lever or push button 1 downward so as to move. elements 2 and 3 inward causing a spark to be generated. A child typically possesses a thumb depressing force of up to 1.5 to 2.0 kgf and therefore a child can often operate the type of prior art lighter depicted by FIG. 1.

DESCRIPTION OF A PREFERRED EMBODIMENT

Figure 2:
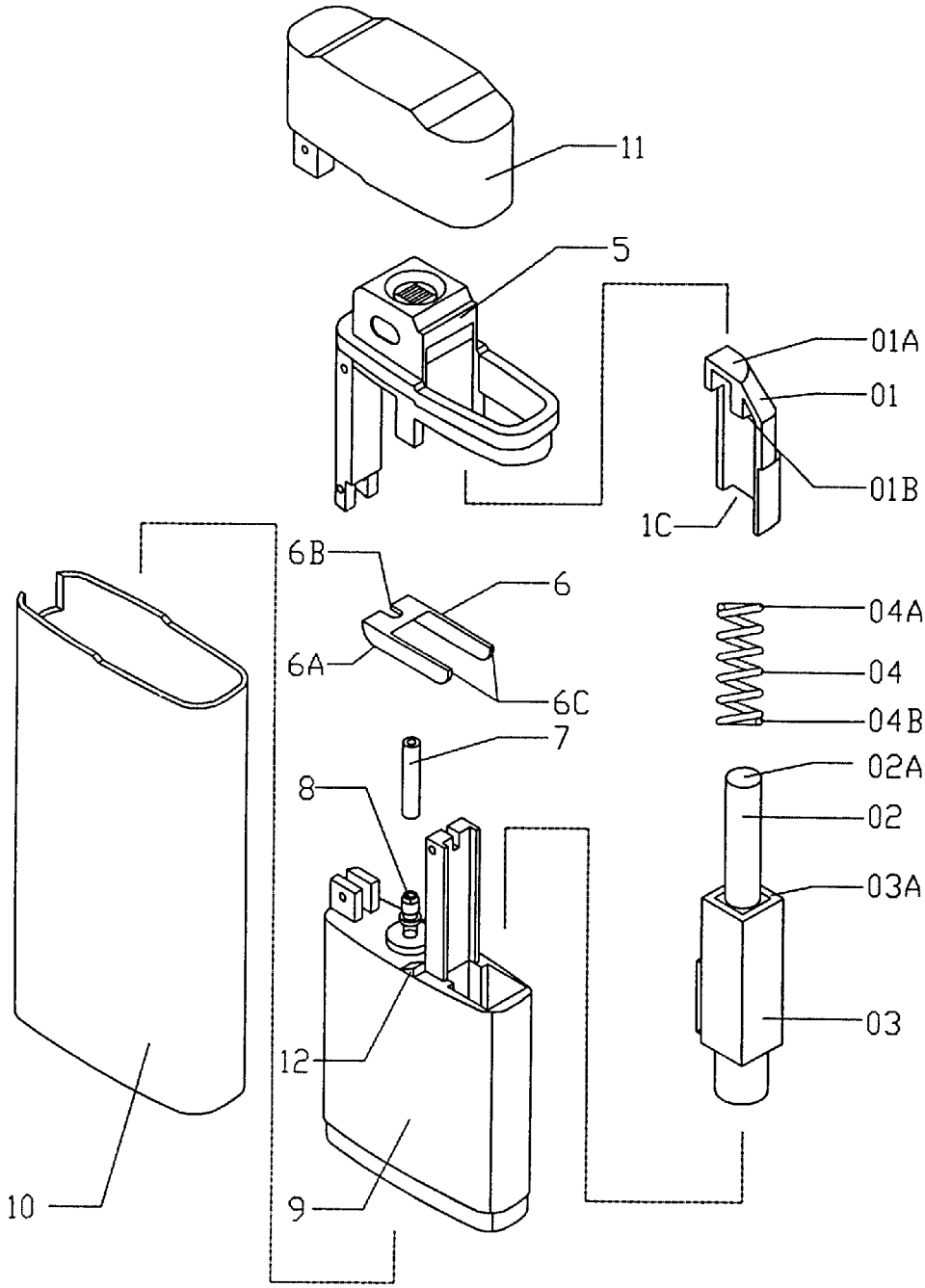
FIG. 2 is an-exploded view of a piezoelectric lighter in accordance with the present invention.

Turning now to FIG. 2, a lighter equipped with a preferred embodiment of the present invention is depicted. It is basically similar to the lighter. shown in FIG. 1, but is provided with a spring 4 which acts against the manual operation of push button or actuating lever 1. The push button 1 and element 2 of piezoelectric igniter 2, 3 are modified to accommodate spring 4.

Figure 2A:
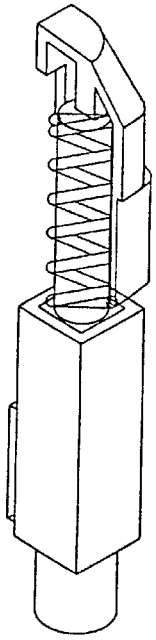
FIGS. 2A and 2B show the push button in its normal unactuated state and in its actuated state, respectively.
Figure 2B:
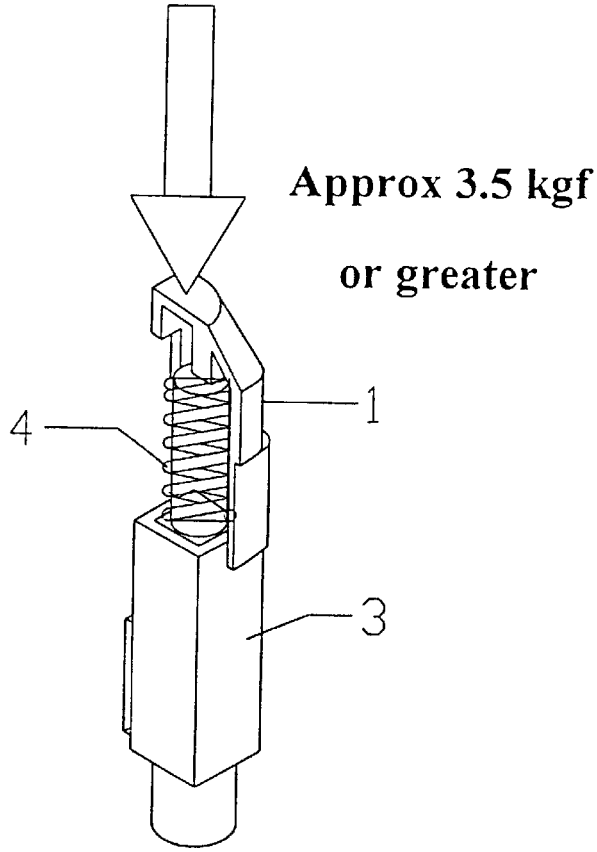
Figure 2C:
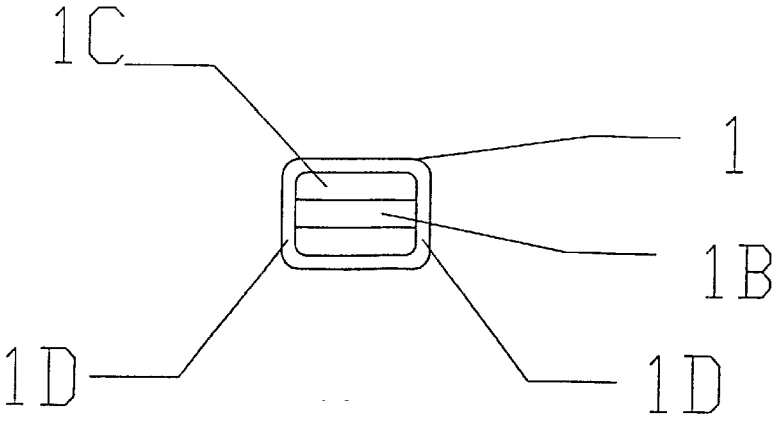
FIG. 2C is a bottom view of the push button or actuating lever.
Figure 3C:
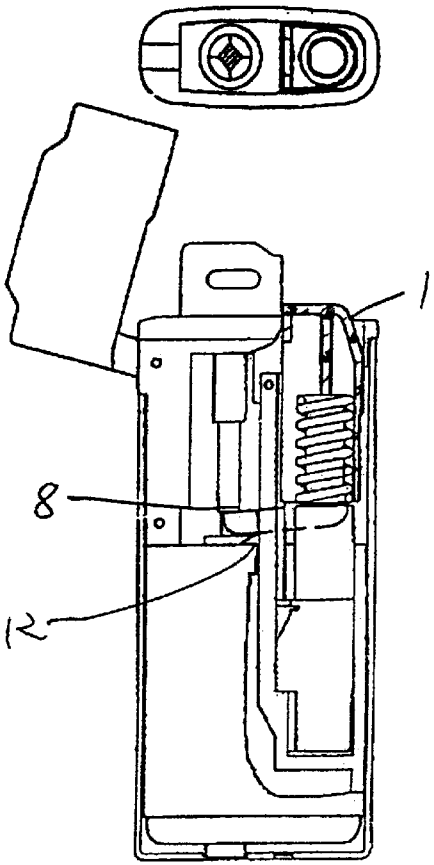
FIGS. 3B and 3C are side-sectional views, partially cut away, showing the internal arrangement of the lighter.
Figure 3B:
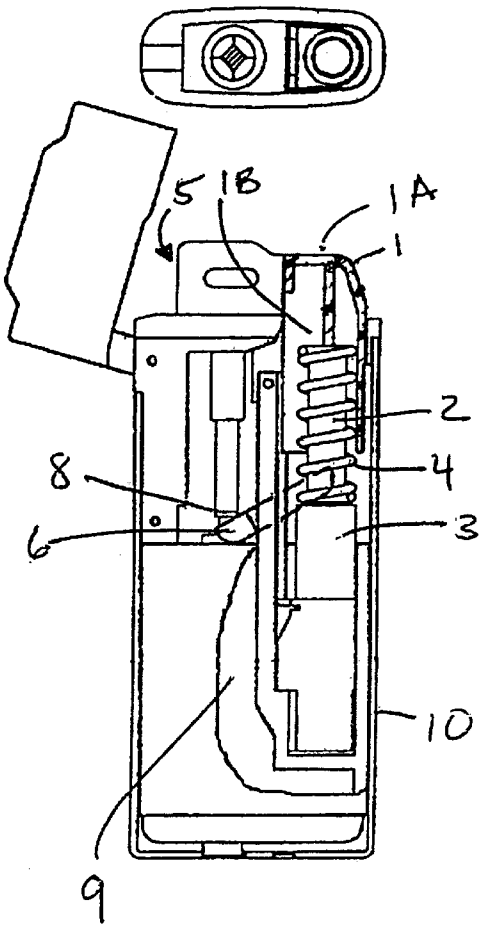
Figure 3A:
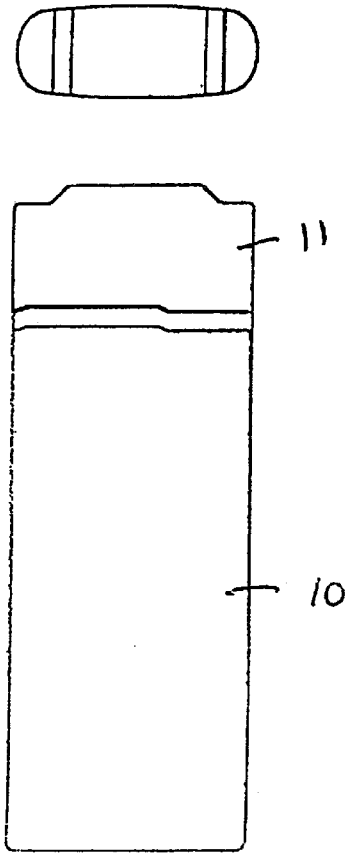
FIG. 3A is a side exterior view of the lighter, shown fully assembled.
Figure 4:
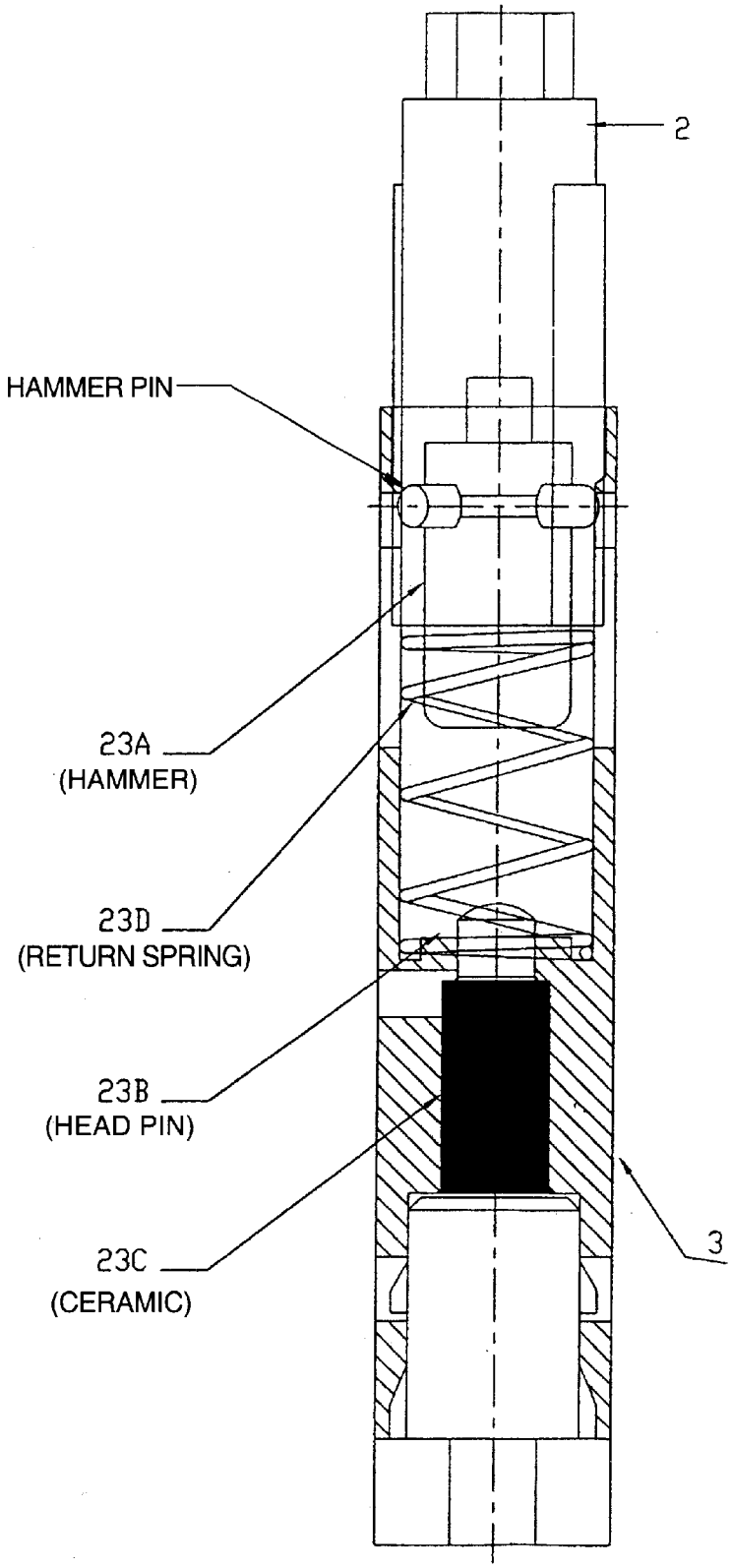
FIG. 4 is a side sectional view of the piezoelectric igniter.

After spring 4 is duly assembled with push button 1 and piezoelectric unit 2, 3 and the remaining parts are assembled, as also shown in FIGS. 3B and 3C, with spring 4 disposed about element 2, which preferably has a columnar shape. The bottom portion 4B of spring 4 rests on shoulder 3A of piezoelectric igniter unit 2, 3. The top 4A of spring 4 engages a shoulder or other surface 1B in the interior of push button 1. Push button 1 is shown in a cutaway view in the FIGS. 2A and 2B and in a bottom view in FIG. 2C in order to show better the interior shoulder 1B which is preferably provided at the base of channel 1C of the push button 1 when practicing the invention.

FIG. 2A shows the igniter, 3 push button or actuating lever 1 and spring 4 combination in its normal, unactuated position. At this time, spring 4 preferably assumes its full normal length in an at rest position without providing any rebounding force.

In order to ignite a flame., the top portion 1A of push button or actuating lever 1 is pressed downwardly, typically by the user's thumb. Element 2 of piezoelectric unit 2, 3 moves downwardly under the action of the projection 1B inside push button or actuating lever 1 and thus assumes the position depicted by FIG. 2B. The movement of element 2 relative to element 3 causes the piezoelectric effect to occur which in turn causes the lighter to be lit. The movement of element 2 also causes gas lever 6 to rock on its rounded front part 6A and against protuberances 12 as its arms 6C move in a clock-wise direction (compare FIGS. 3B and 3C) as the bottom edges 1D of push button 1 bear thereagainst. Only one protuberance 12 is shown for ease of illustration, it being understood that preferably two such protuberances would be provided, one on each side of the lighter. Gas lever 6 has a notch 6B which engages nozzle 8, lifting it when element 2 is pushed downwardly by the action of push button 1. The lifting motion of nozzle 8 causes its associated valve to open and gas to flow from the reservoir 9 in the base of the lighter. Gas flow from nozzle 8 is preferably conducted by a gas pipe 7 to the point of combustion at element 5.

When lighting a flame, spring 4 resists the downward movement of push button or actuating lever 1. Thus, the compression of spring 4 provides a rebounding, upwardly directed force against the movement of push button or actuating lever 1 and therefore the force required to operate the lighter is increased.

The piezoelectric igniter 2,3 includes a hammer 23A which impact a headpin 23B above ceramic 23C. The hammer 23A striking the headpin and hence the ceramic causes an electrical discharge to occur. The piezoelectric unit 2,3 typically includes a return spring 23D for urging element 2 away from element 3. Typically, the force required to overcome spring 23D is on the order of 1.5 to 2.0 kgf. It is preferred to use an auxiliary spring 4 in order to increase the force required to activate the lighter as opposed to merely increasing the spring constant of spring 23D. The reason for this is that increasing the spring constant of spring 23D could tend to shorten the life of the piezoelectric igniter unit 2,3. Thus, the use of an auxiliary spring 4 is preferred.

Preferably, the auxiliary spring 4 is selected such that the force required to light the lighter is at least 3.5 kgf and more preferably falls in the range of 5.5 to 6.0 kgf. A child typically does not possess enough strength to be able to operate push button 1 and also overcome the additional resistance provided by spring 4. An adult, on the other hand, can impart more than enough force using their thumb to overcome the resistance of spring 4 and cause element 2 of the piezoelectric unit to collide with components 23B and 23C of portion 3 of the piezoelectric unit to generate an electrical discharge and light a flame.

When the push button 1 is released, it returns to its normal position shown FIGS. 2A and 3B. This allows arms 6C to move in a counterclockwise direction allowing the valve associated with nozzle 8 to close and the flame to be extinguished.

Assuming that an auxiliary spring 4 is used to increase the force required to activate the lighter as discussed above, then a conventional piezoelectric.igniter 2,3 may be used. Indeed, in practicing the present invention, the applicant prefers to use a conventional piezoelectric igniter 2,3. In the case of some prior art piezoelectric igniters 2,3, they induce a spark when the top element 2 of the piezoelectric unit is moved about 80% of its full possible stroke into element 3. As indicated above, the spring constant of auxiliary spring 4 is selected such that the total force required to activate the lighter, i.e. when the piezoelectric igniter 2,3 is at least 3.5 kgf.

The present invention has been shown in connection with a piezoelectric lighter given the popularity of piezoelectric lighters in the marketplace. Thus, in the preferred embodiment, the invention is used in connection with a piezoelectric lighter. However, the invention can also be used in connection with other prior art lighters, such as those of the type having a mechanical igniter comprising a striker wheel, flint and flint spring combination. It is known, for example, to use a push button or other actuating lever to rotate a striker wheel or other mechanical means to generate a spark from a flint. A spring may be used to resist the depression of such a push button or actuating lever or to resist the rotational movement of the striker wheel to thereby make the lighter difficult to be used when placed in the hands of children, but yet still convenient to use in the hands of an adult.

Having, described the invention in connection with a preferred embodiment thereof, modification may now suggest itself to those skilled in the art. The invention itself is not to be limited to the embodiments disclosed, except as required by the following claims.

What, is claimed is:

1. In a piezoelectric lighter of the type in which a piezoelectric igniter contained in a body structure is responsive to downward movement of a push button to provide a spark to ignite gas being released through a valve to provide a flame wherein said piezoelectric igniter comprises a first element and second element in which the first element extends partially beyond the second element and is coaxically movable with respect to the second element, the second element having an upper end defining a shoulder, and a first spring is contained in the second element adapted to bias the first element to a maximum extended position with respect to the second element, the path of movement of the first element defining an axis which is an axis common to the first spring contained in the second element and the second element is axially immovably relative to the body structure and the push button is positioned above and in contact with an upper end of the first element and is axially movable relative to the second element to push the first element into the second element, the improvement comprising:

a second spring surrounding the first element and having a first end in contact with the push button and a second end in contact with the shoulder of the second element so that when the push button is depressed, the second spring is compressed and the second spring being more resistant to compression than the first spring, whereby the degree of effort to activate the piezoelectric igniter is sufficiently great to render the piezoelectric lighter child resistant such that only a force exceeding the force required to compress the first spring is necessary to cause activation of the piezoelectric igniter.

2. The piezoelectric lighter of claim 1 in which the second spring provides a force necessary to activate the piezoelectric igniter of at least 3.5 kgf.

3. The piezoelectric lighter of claim 1 in which the second spring provides a force necessary to activate the piezoelectric igniter in the range of approximately 5.5 to approximately 6.0 kgf.

4. The piezoelectric lighter of claim 1 in which the second spring is responsive by compressing to depression of the push button through the entire depressing travel of the push button whereby the exceeding force is present through the entire depressing travel of the push button until the piezoelectric igniter causes a spark.

5. A piezoelectric lighter comprising:

a gas container having an outlet valve through which ignitable gas is released;

a piezoelectric igniter having a first element mounted for reciprocating movement within a second element and having a portion exterior to the second element and having a spring inside the second element biasing the first element to an extended position and resisting its movement to a retracted position, the piezoelectric igniter being operative to produce a spark when the first element is sufficiently axially retracted into the second element;

a push-button operative by depression to cause opening of said outlet valve and axial movement of the first element in the retracting direction to produce a spark;

a second spring contributing a second predetermined force resisting depression of the push button by a resisting force greater than that of the first spring, the second spring having one end in contact with the push button and a second end ridigly fixed with respect to movement of the push button;

whereby said piezoelectric lighter is constructed and arranged such that the total force required to depress the push button is child resistant, by which a force exceeding the force necessary to compress the first spring is necessary to cause ignition of the piezoelectric lighter.

6. The piezoelectric lighter of claim 5 in which the second spring surrounds the first element and is compressed upon depression of the push button simultaneously with the axial movement of the first element in the retracting direction.

7. The piezoelectric lighter of claim 6 in which the second element has an upper end defining a shoulder and the second spring's second end is in contact with the shoulder.

* * * * *